US009370754B2

(12) United States Patent
McClimond

(10) Patent No.: US 9,370,754 B2
(45) Date of Patent: Jun. 21, 2016

(54) FOAM GENERATION APPARATUS

(71) Applicant: Mr. Foamer Inc., Jupiter, FL (US)

(72) Inventor: James T. McClimond, Jupiter, FL (US)

(73) Assignee: Mr. Foamer Inc., Jupiter, FL (US)

( * ) Notice: Subject to any disclaimer, the term of this patent is extended or adjusted under 35 U.S.C. 154(b) by 114 days.

(21) Appl. No.: 14/229,819

(22) Filed: Mar. 28, 2014

(65) Prior Publication Data

US 2014/0291873 A1 Oct. 2, 2014

Related U.S. Application Data

(60) Provisional application No. 61/806,814, filed on Mar. 29, 2013.

(51) Int. Cl.

| | |
|---|---|
| ***B01F 3/04*** | (2006.01) |
| ***B01F 5/06*** | (2006.01) |
| ***B01F 15/00*** | (2006.01) |

(52) U.S. Cl.

CPC ..... *B01F 5/0696* (2013.01); *B01F 3/0446* (2013.01); *B01F 3/04446* (2013.01); *B01F 3/04992* (2013.01); *B01F 15/00928* (2013.01)

(58) Field of Classification Search

CPC ..... B01F 3/40; B01F 3/04992; B01F 3/0446; B01F 3/04446; B01F 5/0696; B01F 15/00928; B60S 3/04

USPC ..... 261/95, 101, 108, DIG. 26

See application file for complete search history.

(56) References Cited

U.S. PATENT DOCUMENTS 9,132,393 B1 * 9/2015 Ross ..... B01F 5/0666

OTHER PUBLICATIONS

Motor City Wash Works, Inc., Mega Foam Chamber, The Motor City Wash Works Car Wash Catalog, vol. 3, 2007, pp. 153 and 164.

New Wave Innovations, Inc., Turbo Foam Generator, www.new-waveinnovations.us/Products.html, 2011.

* cited by examiner

*Primary Examiner* — Robert A Hopkins

(74) *Attorney, Agent, or Firm* — Steven M. Greenberg; CRGO Law

(57) ABSTRACT

A foam generation apparatus is claimed. The apparatus includes a housing defining an interior portion and two ports disposed on an exterior surface of the housing. One of the ports is adapted to receive chemical into the interior portion of the housing, and another of the ports is adapted to receive compressed air into the interior portion of the housing. The apparatus also includes coarse threads integrally molded at a top portion of the housing. Finally, the apparatus includes an insert that includes a cap, a rod extending from an interior portion of the cap, and one or more agitation balls affixed to the rod. Like the housing, the cap also includes coarse threads formed therein. As such, the insert is disposed within the housing and secured to the housing by way of the coarse threads of the insert and the housing.

5 Claims, 5 Drawing Sheets

FOAM GENERATION APPARATUS

CROSS REFERENCE TO RELATED APPLICATIONS

This application claims the benefit under 35 U.S.C. §119 (e) of U.S. Provisional Application No. 61/806,814, filed Mar. 29, 2013, the entire teachings of which are incorporated herein by reference.

BACKGROUND OF THE INVENTION

1. Field of the Invention

The present invention relates to automated vehicle washing systems and more particularly to foam generators for use in automated vehicle washing systems.

2. Description of the Related Art

Foam generators make foam when mixed in a housing with compressed air and a pressurized chemicals. The generated form then can be discharged to chemical distribution equipment, which in turn applies the foamed chemical onto vehicles, for the purpose of cleaning and protecting the exterior surfaces of vehicles.

BRIEF SUMMARY OF THE INVENTION

Embodiments of the present invention address deficiencies of the art in respect to foam generation and provide a novel and non-obvious foam generation apparatus. In an embodiment of the invention, a foam generation apparatus makes foam in a clear non-glued, plastic housing when mixed with compressed air and a pressurized chemical. The generated foam then is discharged to chemical distribution equipment, which applies the foamed chemical onto vehicles, for the purpose of cleaning and protecting the exterior surfaces of vehicles.

Of note, the foam generation apparatus has a molded cap that thread on to the clear, non-glued housing. The cap has a non-corrosive rod that holds two types of media to aid in generating foam. Of note, due to the molded removable cap, servicing the foam generation apparatus can be quicker and easier than traditional foaming devices.

Additional aspects of the invention will be set forth in part in the description which follows, and in part will be obvious from the description, or may be learned by practice of the invention. The aspects of the invention will be realized and attained by means of the elements and combinations particularly pointed out in the appended claims. It is to be understood that both the foregoing general description and the following detailed description are exemplary and explanatory only and are not restrictive of the invention, as claimed.

BRIEF DESCRIPTION OF THE SEVERAL VIEWS OF THE DRAWINGS

The accompanying drawings, which are incorporated in and constitute part of this specification, illustrate embodiments of the invention and together with the description, serve to explain the principles of the invention. The embodiments illustrated herein are presently preferred, it being understood, however, that the invention is not limited to the precise arrangements and instrumentalities shown, wherein.

DETAILED DESCRIPTION OF THE INVENTION

In accordance with an embodiment of the invention, a foam generation apparatus includes a housing. The housing is a one piece molded, non-glued, clear plastic material housing. The housing includes coarse, molded threads at a top end, and two, molded, threaded intake ports—the ports disposed on each side of the housing. One intake port is adapted to received compressed air and the other intake port is adapted to receive pressurized chemical. Molded, female threads are disposed at a bottom end of the the housing so as to enable various fittings to connect to other equipment to discharge foam.

An insert can be provided for the housing. The insert can include a molded plastic cap, with coarse molded threads complementary to the course, molded threads at the top end of the housing. The insert also can include a molded gasket retainer with one gasket. One fully threaded, non-corrosive rod is inserted into the molded cap, through a hole and secured at the top with one, noncorrosive lock nut and one, non-corrosive, neoprene seal washer. One, non-corrosive neoprene seal washer and one, non-corrosive, lock nut is placed on the fully threaded, non-corrosive rod on the inside of the molded cap. Multiple fin, non-corrosive, plastic agitation balls and sturdy, dense, washable fibrous pads are assembled on the fully, threaded, non-corrosive rod. To completely secure the insert, one, noncorrosive, cupped washer and one, non-corrosive lock nut is placed at the end of the fully threaded, non-corrosive rod.

Figure 1:
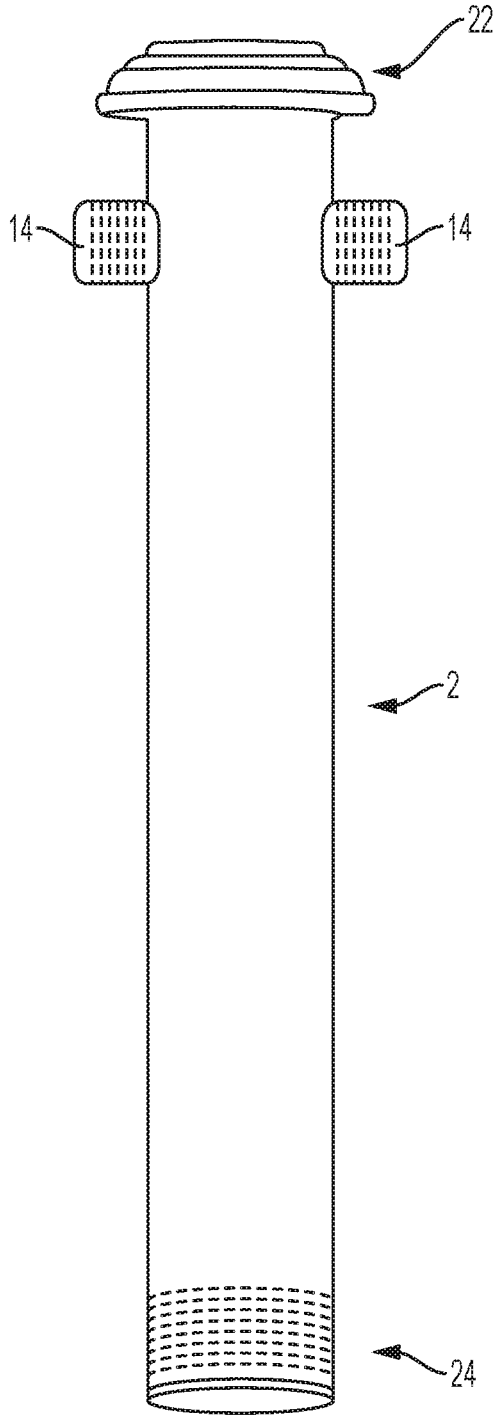
FIG. 1 is a front view of the foam generation apparatus without the insert.

In further illustration, FIG. 1 depicts a front view of the Foam generation apparatus without the insert. As shown in FIG. 1, a clear non-glued cylindrical plastic housing (2) is provided along with molded in metal threaded inserts (14), coarse molded cap threads (22), and molded female bottom threads (24).

Figure 1A:
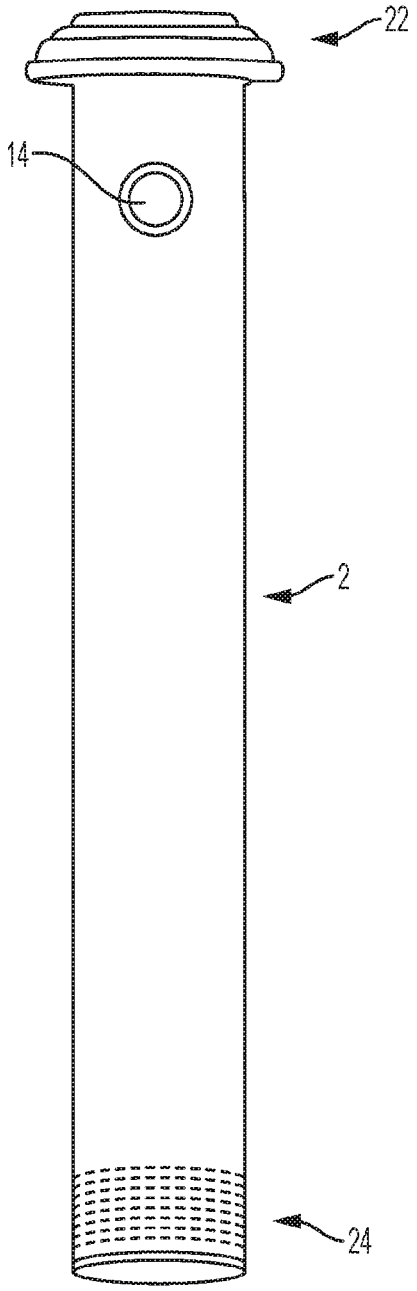
FIG. 1A Is a side view of the foam generation apparatus without the insert.

FIG. 1A depicts a front view of the foam generation apparatus without the insert. FIG. 1A specifically shows a clear non-glued cylindrical plastic housing (2), with molded in metal threaded inserts (14), coarse molded cap threads (22), and molded female bottom threads (24)

Figure 2:
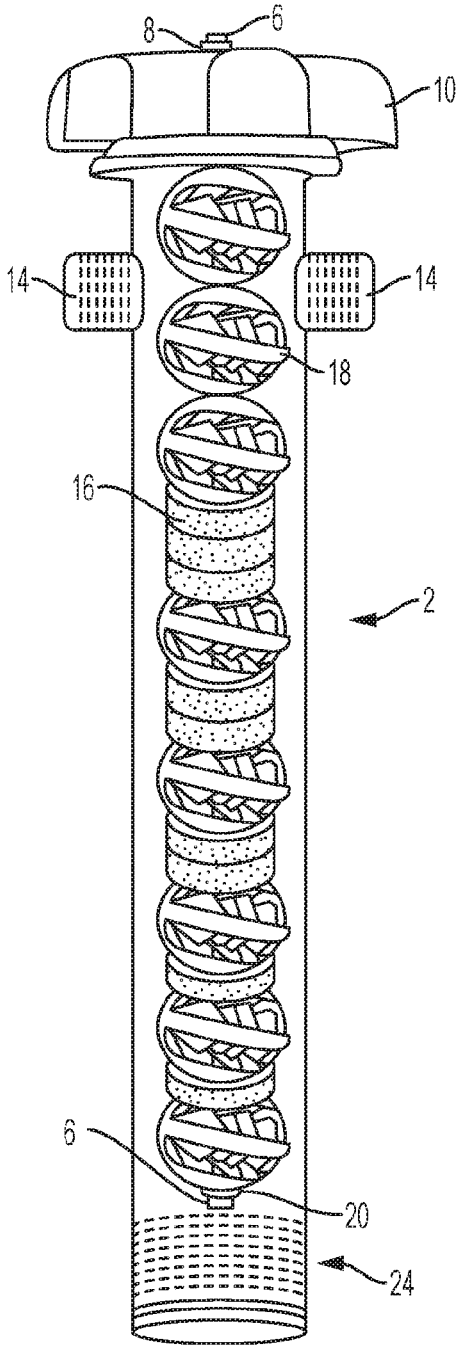
FIG. 2 Is a front view of the foam generation apparatus with insert shown.

FIG. 2 depicts a front view of the foam generation apparatus with insert shown. As shown in FIG. 2, a clear non-glued cylindrical plastic housing (2) is provided with molded in metal threaded inserts (14), coarse molded cap threads (22), molded female bottom threads (24), multiple fibrous disc pads (16), multiple plastic bio balls (18), stainless lock nuts (6), stainless finishing washer (20), stainless neoprene washer (8) and a cap (10)

Figure 3:
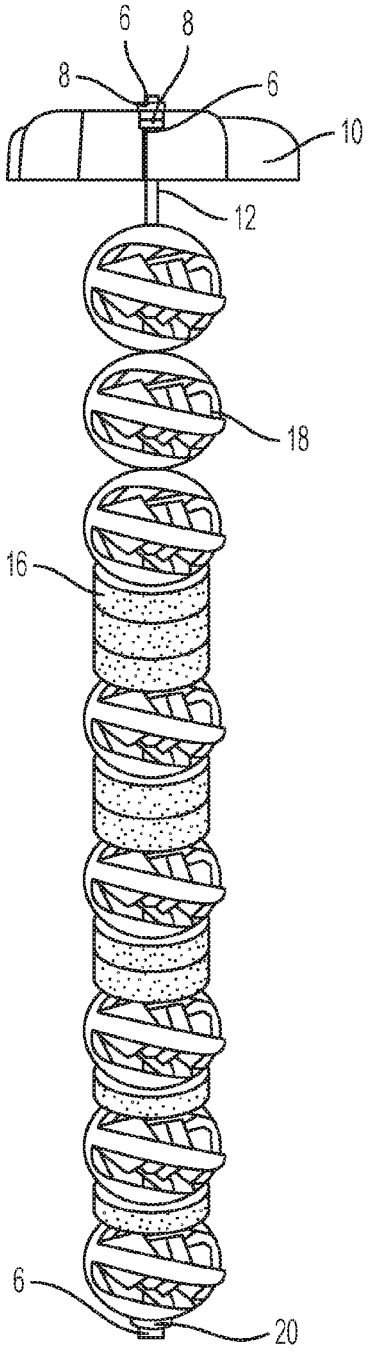
FIG. 3 Is a perspective view of the insert only.

FIG. 3 depicts a perspective view of the insert absent a housing of the foam generation apparatus. As shown in FIG. 3, multiple fibrous disc pads (16) are provided with the insert. Also included are multiple plastic bio balls (18), stainless lock nuts (6), stainless finishing washer (20), stainless neoprene washer (8), cap (10), and stainless threaded rod (12).

Figure 4:
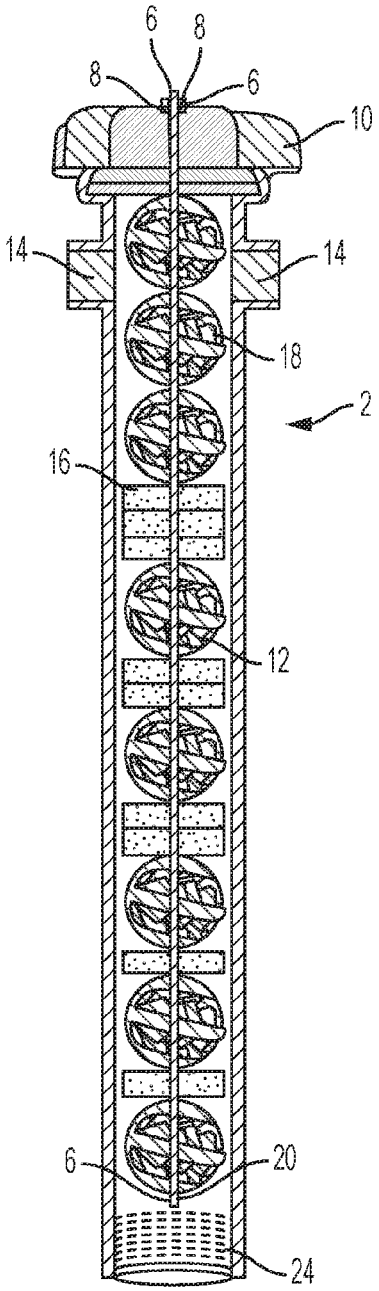
FIG. 4 Is a section view of the foam generation apparatus FIG. 2.

FIG. 4 depicts a section view of the foam generation apparatus. As shown in FIG. 4, a clear non-glued cylindrical plastic housing (2) is provided. The housing (2) includes molded in metal threaded inserts (14), coarse molded cap threads (22), molded female bottom threads (24), multiple fibrous disc pads (16), multiple plastic bio balls (18), stainless lock nuts (6), stainless finishing washer (20), stainless neoprene washer (8), Cap (10), and stainless threaded rod (12).

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

I claim:

1. A foam generation apparatus comprising:

a housing defining an interior portion;

two ports disposed on an exterior surface of the housing, one of the ports adapted to receive chemical into the interior portion of the housing, another of the ports adapted to receive compressed air into the interior portion of the housing;

coarse threads integrally molded at a top portion of the housing; and, an insert comprising a cap, a rod extending from an interior portion of the cap, and one or more agitation balls affixed to the rod, the cap comprising coarse threads formed therein, the balls each comprising multiple fins with each ball having been formed of non-corrosive material, the insert being disposed within the housing and secured to the housing by way of the coarse threads of the insert and the housing.

2. The apparatus of claim 1, wherein fibrous pads also are affixed to the rod along with the agitation balls.

3. The apparatus of claim 1, wherein an end of the housing opposite the coarse threads comprises molded female threads adapted for coupling to a equipment receiving foam discharges from the housing.

4. The apparatus of claim 1, wherein the rod is threaded and positioned within an opening in the cap with a portion of the rod extending beyond an exterior portion of the cap, and wherein a neoprene washer and a non-corrosive lock nut are affixed to threads on the portion of the rod extending beyond the exterior portion of the cap.

5. The apparatus of claim 1, wherein a gasket is disposed within a molded gasket retainer in the cap.

* * * * *